US008327527B2

(12) United States Patent
Christenson

(10) Patent No.: US 8,327,527 B2
(45) Date of Patent: Dec. 11, 2012

(54) INTEGRATED REED SWITCH

(75) Inventor: Todd R Christenson, Albuquerque, NM (US)

(73) Assignees: HT Microanalytical, Inc., Albuquerque, NM (US); Coto Technology, Inc., Warwick, RI (US)

( * ) Notice: Subject to any disclaimer, the term of this patent is extended or adjusted under 35 U.S.C. 154(b) by 460 days.

(21) Appl. No.: 12/406,937

(22) Filed: Mar. 18, 2009

(65) Prior Publication Data

US 2009/0237188 A1 Sep. 24, 2009

Related U.S. Application Data

(60) Provisional application No. 61/038,340, filed on Mar. 20, 2008.

(51) Int. Cl.
*H01H 11/00* (2006.01)
*H01H 65/00* (2006.01)
*H01H 51/22* (2006.01)

(52) U.S. Cl. ..... 29/622; 335/78; 335/83; 335/86; 335/151; 335/154

(58) Field of Classification Search ..... 335/78–86, 335/151–154; 29/622
See application file for complete search history.

(56) References Cited

U.S. PATENT DOCUMENTS

| | | | | | |
|---|---|---|---|---|---|
| 2,497,547 | A | * | 2/1950 | Hastings | 335/270 |
| 2,931,872 | A | * | 4/1960 | Sprando | 335/83 |
| 3,087,125 | A | * | 4/1963 | Scholefield | 333/262 |
| 3,167,625 | A | * | 1/1965 | Russo | 335/154 |
| 3,268,839 | A | * | 8/1966 | McFarland | 335/151 |
| 3,486,138 | A | * | 12/1969 | Chalmers et al. | 335/151 |
| 3,535,663 | A | * | 10/1970 | Herzog et al. | 335/151 |

(Continued)

FOREIGN PATENT DOCUMENTS

DE 10031569 A1 2/2001

OTHER PUBLICATIONS

Copenheaver, Blaine R., "PCT Application No. PCT/US2009/037575 International Search Report May 20, 2009", , Publisher: PCT, Published in: PCT.

(Continued)

*Primary Examiner* — Mohamad Musleh
(74) *Attorney, Agent, or Firm* — Kaplan Breyer Schwarz & Ottesen, LLP

(57) ABSTRACT

This invention relates to reed switches, and more particularly to micro-miniaturized reed switches and batch microfabrication techniques used to fabricate micro-miniaturized reed switches. The present invention can provide miniaturized reed switches with more consistent operating parameters, and that can be produced more efficiently than conventional reed switches. The present invention can also provide methods of making miniaturized reed switches using microfabrication techniques. The present invention can use lithographic-based fabrication to enable monolithic construction of a reed switch. Microlithography can repeatedly form micrometer dimensions with tight tolerances over large arrays of devices which, if the patterns are translated into materials appropriate for electromechanical devices, can provide for repeatable and consistent electromechanical operation. For example, tight dimensional control of the gap between two reeds in a reed switch or a reed and a fixed contact can provide consistency of performance between reed switches. Thus, the present invention can allow the commonly regarded reed switch specification of sensitivity, or "Ampere-turns" required to close a reed switch, to be tightly controlled with a commensurate reduction in spread in sensitivity across reed switch production lots.

18 Claims, 20 Drawing Sheets

U.S. PATENT DOCUMENTS

| | | | | |
|---|---|---|---|---|
| 3,579,158 | A * | 5/1971 | Kutyla | 335/151 |
| 3,586,809 | A * | 6/1971 | Santi | 200/263 |
| 3,913,054 | A * | 10/1975 | Wolfe | 337/362 |
| 4,011,533 | A * | 3/1977 | Santi | 335/154 |
| 4,063,203 | A * | 12/1977 | Fujiwara et al. | 335/154 |
| 5,430,421 | A * | 7/1995 | Bornand et al. | 335/154 |
| 6,040,748 | A * | 3/2000 | Gueissaz | 335/78 |
| 6,094,116 | A | 7/2000 | Tai et al. | |
| 6,366,186 | B1 | 4/2002 | Hill et al. | |
| 6,410,360 | B1 | 6/2002 | Steenberge | |
| 6,917,268 | B2 | 7/2005 | Deligianni et al. | |
| 6,924,966 | B2 | 8/2005 | Prophet | |
| 7,191,509 | B2 | 3/2007 | Van Gastel | |
| 7,215,229 | B2 * | 5/2007 | Shen et al. | 335/78 |
| 7,864,006 | B2 * | 1/2011 | Foster et al. | 335/78 |
| 2004/0150939 | A1 * | 8/2004 | Huff | 361/277 |
| 2006/0197635 | A1 | 9/2006 | Christenson | |
| 2009/0189720 | A1 * | 7/2009 | Debarnot et al. | 335/84 |

OTHER PUBLICATIONS

Socher, Guenther, "PCT Application No. PCT/US2011/027930 International Search Report Jun. 9, 2011", , Publisher: PCT, Published in: PCT.

Socher, Guenther, "PCT Application No. PCT/US2011/027930 Written Opinion of the International Preliminary Examining Authority Mar. 27, 2012", , Publisher: PCT, Published in: PCT.

* cited by examiner

INTEGRATED REED SWITCH

CROSS-REFERENCE TO RELATED APPLICATIONS

This application claims priority to U.S. provisional application 61/038,340, filed Mar. 20, 2008, which is incorporated herein by reference.

FIELD OF THE INVENTION

This invention relates to reed switches, and more particularly to micro-miniaturized reed switches and batch microfabrication techniques used to fabricate micro-miniaturized reed switches.

BACKGROUND

Dry reed switches are commonly comprised of two overlapping soft ferromagnetic electrically conducting cantilevers (reeds) separated by a small gap and supported by a glass hermetic enclosure. Upon application of a magnetic field the two opposing cantilevers are attracted to each other and establish electrical contact between the reeds. In the absence of a magnetic field the cantilevers resort to their original separated and electrically insulating state. Numerous electromechanical and electrical variations of this basic "single-pole, single-throw" normally open switch are used as well.

Various dry and wet reed switch designs have been proposed, for example those described in U.S. Pat. No. 7,321,282 "MEM's reed switch array"; U.S. Pat. No. 7,227,436 "Modular reed switch assembly and method for making"; U.S. Pat. No. 5,883,556 "Reed switch"; U.S. Pat. No. 5,847,632 "Reed switch"; U.S. Pat. No. 4,837,537 "Reed switch device"; U.S. Pat. No. 4,329,670 "Mercury reed switch"; and U.S. Pat. No. 4,039,985 "Magnetic reed switch".

Conventional reed switch designs, however, can be costly to produce, and can exhibit a wide range of operating parameters even in switches of the same design. They are also generally constrained to specific relative orientations of the external electrical contacts and the applied magnetic field. For example, conventional glass encapsulated reed switches are fabricated with their leads extending axially from a cylindrically shaped glass ampule and are most sensitive to an externally applied magnetic field oriented along the axis of the leads.

Microfabricated reed switches have been proposed, for example in U.S. Pat. Nos. 5,430,421; 5,605,614, and 6,040,748. These generally rely on beam motion normal to the plane of deposition, which can pose difficulties in fabrication and packaging, for example by stress gradients in the materials that make consistent performance difficult to realize. Such designs also can suffer from problems with beam stiffness (i.e., it is generally desirable that the beam have a predictable stiffness in the direction of desired bending, and a high stiffness in other directions). Such designs also typically have a small anchor spot of the beam, resulting in low sensitivity to applied magnetic fields and consequently unacceptable performance (especially in miniature switches). Such designs also typically have coplanar external electrical connections, which can be unwieldy for use in surface mount electronics assembly.

The integrated reed switch described in this invention can be constructed to have more arbitrary orientation of its sensitive axis and electrical leads that can be oriented normal to and directly beneath the reed switch structure.

SUMMARY OF INVENTION

Embodiments of the present invention can provide miniaturized reed switches with more consistent operating parameters that can be produced more efficiently than conventional reed switches. The present invention can also provide methods of making miniaturized reed switches using microfabrication techniques.

The present invention can use lithographic-based fabrication to enable monolithic construction of a reed switch. Batch lithographic-based microfabrication can provide high manufacturing volume and can contribute to improved repeatability by facilitating enhanced dimensional control. Microlithography can repeatedly form micrometer dimensions with tight tolerances over large arrays of devices which, if the patterns are translated into materials appropriate for electromechanical devices, can provide for repeatable and consistent electromechanical operation. For example, tight dimensional control of the gap between two reeds in a reed switch or a reed and a fixed contact can provide consistency of performance between reed switches. Thus, the present invention can allow the commonly regarded reed switch specification of sensitivity, or "Ampere-turns" required to close a reed switch, to be tightly controlled with a commensurate reduction in spread in sensitivity across reed switch production lots. Since the cost of a microfabricated device is generally proportional to the substrate area which it occupies, the present invention can provide microfabricated reed switches with small substrate footprints.

An important aspect to reed switch microfabrication is the tolerance of the blade thickness since the mechanical stiffness of the reed blade is proportional to the third power (cube) of its thickness in the direction of bending, while its width or dimension normal to the direction of bending has only a linear impact the stiffness of the reed blade. One approach to microlithographic construction of reed switches is to pattern the blade so that direction of motion is normal (perpendicular) to the plane of the microfabrication substrate. In this approach, the beam thickness and corresponding thickness tolerance is dictated by control of the blade material deposition rate and the blade width, which is its dimension normal to its motion, is lithographically determined. Therefore, the thin film surface microfabricated topology as depicted in FIG. 20 has a magnetic sensitivity to closure which depends on the out of plane thickness of the beam usually dictated by deposition rate which can vary considerably across the substrate area and from substrate to substrate. Another approach to the microfabrication of a reed switch is to construct the reed blade such that its thickness is lithographically determined which creates a blade whose direction of motion is parallel to the fabrication substrate. For typical reed switch geometry wherein the reed width may be 100s of micrometers to millimeters with thickness of 10s of micrometers, the construction of a reed switch with motion parallel to the substrate results in a geometry with so-called "high aspect-ratio" and is shown in FIG. 21. The bending stiffness parallel to the substrate of a high aspect-ratio magnetic reed cantilever is much less than its stiffness normal to the substrate providing for motion in a direction parallel to the plane of the substrate. Microfabrication processes capable of accurately patterning high aspect-ratio structures include x-ray based and thick ultraviolet microlithography with electroforming and deep silicon chemical etching. In any case, with this approach a reed switch blade can be fabricated so that its thickness is accurately defined along its entire width thereby yielding a cantilever with repeatable and precise compliance across a microfabrication substrate which provides for tightly controlled magnetic sensitivity of switch closure. Conventional glass encapsulated reed switches are produced by a relatively inaccurate stamping process which leads to poor thickness control and thus high variation in magnetic sensitivity.

Reed switch miniaturization can involve several physical scaling constraints. Good reed switch performance can require, for example, low and repeatable contact resistance during electrical closure which in turn can require sufficiently high contact electromechanical force. As a reed switch is miniaturized and its total package volume decreases, however, the contact force decreases with area of the overlapping contacts for a constant excitation field. In addition, the coupling of a reed switch to an external magnetic field can suffer with diminishing scale.

The functional device, economic, and fabrication constraints for a microfabricated reed switch as briefly discussed above encourage planar fabrication that can support structure definition extending considerably (100s of micrometers) out of the plane of the manufacturing substrate. This type of processing can be referred to as "high aspect-ratio" processing where the thickness out of the processing plane of a device feature can be much larger than corresponding lateral or in-plane dimensions. This allows offsetting of some of the detriments of the volume scaling of a reed switch if it is fabricated with its compliant direction in the plane of the substrate since the width of the reed blades (height above the substrate) can be made several hundred micrometers. At the same time, the amount of substrate area required to accommodate the reed switch overlap area remains small and is unaffected by increased blade width and consequent blade overlap.

Reed switches according to the present invention can also provide for maintaining sensitivity at reduced size relative to other reed switches. Sensitivity of a reed switch relates to the amount of magnetic field required for activation. As a reed switch is reduced in size the ability to couple magnetic field into the reed switch gap is diminished. In order to maintain sensitivity of a reed switch at micro-miniature scale, example embodiments of the present invention incorporates a patterned base of ferromagnetic material extending out from and in some cases partially surrounding the reed cantilevers.

Maintaining force to in turn maintain low contact resistance for a miniaturized reed relay can also involve scaling dependences. Example embodiments of the present invention can incorporate a single cantilever with a stationary contact feature. For a constrained maximum device volume the use of a single cantilever can allow incorporation of more ferromagnetic material for enhanced coupling to an externally applied magnetic field. For a given switch gap the reaction difference between a single cantilever contacting a fixed contact and two cantilevers each deflecting half the gap to form contact can be described as follows. For a clamped-free cantilever of length l, thickness h, width b, Young's modulus E, and force at tip end P, the tip deflection is:

$$\delta = \frac{Pl^3}{3EI},$$

where the moment of inertia, l is, $$I = \frac{bh^3}{12}.$$

For two cantilever reeds with gap g, and length $l=l_m/2$, a deflection, $$\delta = \frac{g}{2},$$

is needed for each cantilever and the corresponding force required to produce this deflection is, $$P_{2c} = Ebg\left(\frac{h}{l_m}\right)^3.$$

For one cantilever with gap, g and l=lm, a deflection, δ=g, is needed and the corresponding force required to produce this deflection is, $$P_{1c} = \frac{Ebg}{4}\left(\frac{h}{l_m}\right)^3,$$

or 4 times less force to deflect the single cantilever a given gap distance than for two cantilevers. Thus, if there exists sufficient reed spring stiffness to reliably disengage the reed cantilever from electrical contact and provide sufficiently for resistance to shock and vibration, a single cantilever switch will not diminish the contact force for a given reed gap as much as a dual cantilever reed switch.

The present invention can also provide another means to reduce the compliance of the reed cantilever in a reed switch by providing a locally reduced cross section in the reed near its base or mechanical anchor. Although this increases the magnetic reluctance of the blade and the ability therefore to couple magnetic field to the contact gap, in some applications this can be an acceptable tradeoff to enhance reed switch sensitivity. By using microlithographic patterning such a narrowed pattern can be constructed in a nearly arbitrary way with sub-micrometer tolerances and thus for typical blade thicknesses of 25-100 micrometers provide suitable blade stiffness accuracy and repeatability.

BRIEF DESCRIPTIONS OF DRAWINGS

The accompanying drawings, which are incorporated into and form a part of the specification, illustrate one or more embodiments of the present invention and, together with the description, serve to explain the principles of the invention. The drawings are only for the purpose of illustrating one or more example embodiments of the invention and are not to be construed as limiting the invention.

DESCRIPTION OF INVENTION

Example Reed Switch Embodiments

Example embodiments of a microfabricated reed switch according to the present invention can comprise an electrically insulating substrate provided with electrical vias or feedthroughs, a reed switch mechanism, a cover to provide hermetic sealing of the reed switch, and electrically conducting pads to provide electrical connection to the reed switch. The figures generally show only a single example switch, comprising only a dice portion of a wafer or die pertaining to a single switch device. In production, many such switches (or other devices) can be fabricated on a single substrate.

Figure 1:
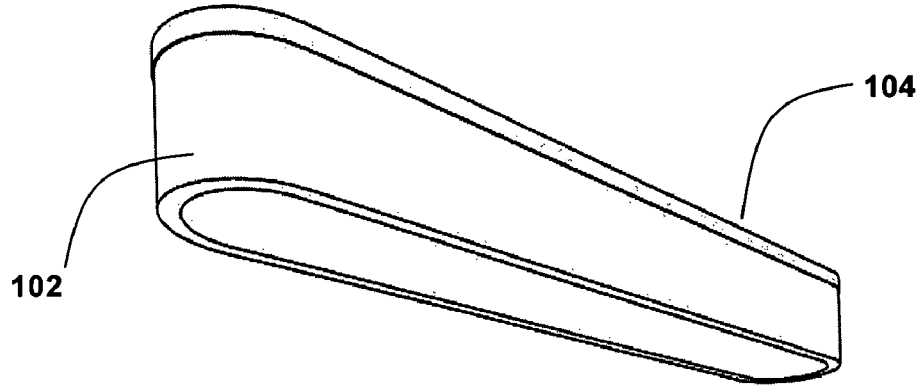
FIG. 1 is an exploded view of an example integrated single pole—single throw ("SPST" or "form A") reed integrated reed switch.
Figure 1:
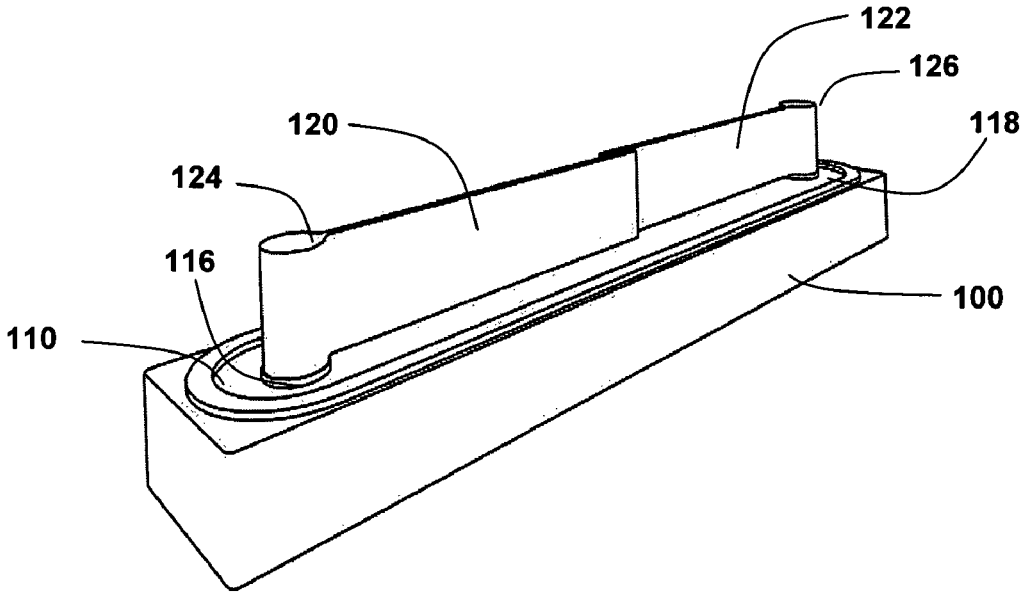
Figure 2:
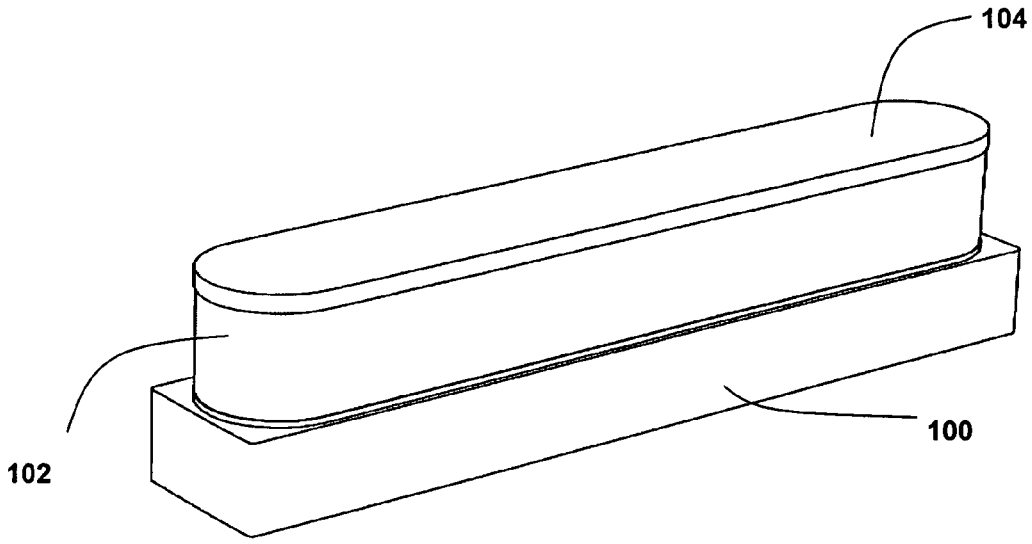
FIG. 2 is a view of an example sealed, packaged and singulated reed switch.
Figure 3:
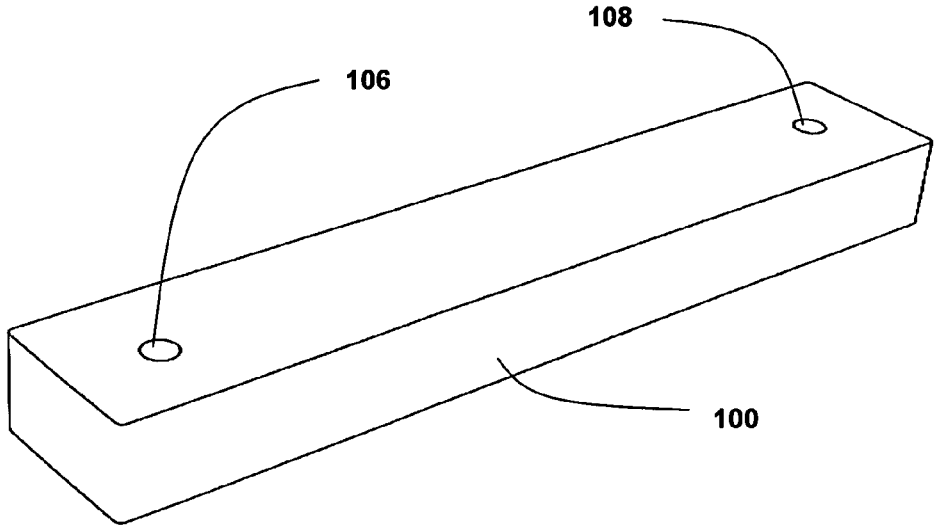
FIG. 3 is a top view of the substrate and substrate vias of an example integrated reed switch.
Figure 4:
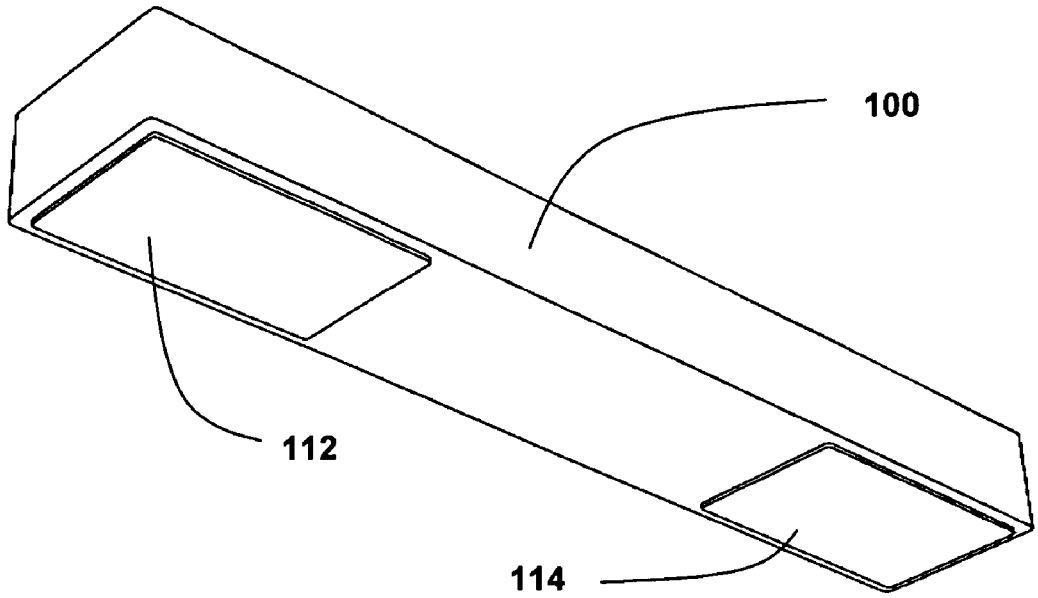
FIG. 4 is a bottom view of an example integrated reed switch substrate with electrical connections.

FIG. 1 is an exploded view of an example integrated single pole—single throw ("SPST" or "form A") integrated reed switch. FIG. 2 is a view of the example switch of FIG. 1 sealed, packaged and singulated. A substrate 100 has electrical vias 106, 108 as shown in the view of the example switch in FIG. 3. The substrate can comprise any of a variety of electrically insulating materials, as examples glass, alumina, and SiO2 dielectric coated silicon. Vias 106, 108 can comprise electrically conducting material such as gold, copper, silver or nickel and can be hermetically attached to the substrate. FIG. 4 is a bottom view of a substrate like that shown in FIG. 3, with electrical pads 112, 114 comprising an electrically conductive material such as gold patterned on the bottom of the substrate. Electrical pads 112, 114 can be connected to an external electrical circuit via soldering or a suitable electrical fixture.

Figure 6:
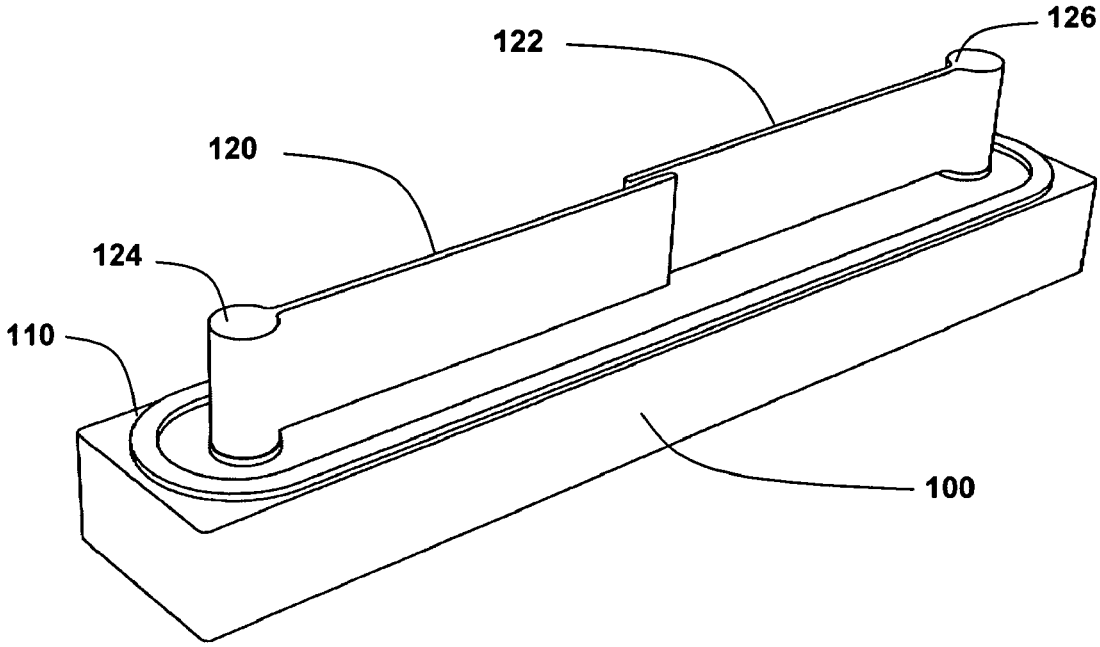
FIG. 6 is a top view of an example integrated reed switch with reeds.

FIG. 6 is a top view of the electromechanical portion of the example integrated reed switch of FIG. 1. The electromechanical portion comprises ferromagnetic blades 120, 122 with supports or anchors 124, 126 attached to spacing features 116, 118. The ferromagnetic blades can comprise soft ferromagnetic material (e.g., ferromagnetic material with large permeability such as the various Permalloys) which can be coated with a suitable contact metallurgy including but not limited to gold, silver, ruthenium, rhodium and platinum. Note that the blades have what is referred to as a "high aspect ratio", meaning that the blade thickness normal to the plane of deposition is much greater than the thickness in the plane. A high aspect ratio can provide various advantages. For example, the thickness in the plane of deposition and actuation can be controlled as a feature width in the processing, amenable to tight control and consequently predictable stiffness and actuation force requirement. As another example, vertical strain gradients often occur with variously deposited materials. Such strain gradients can lead to distortion of the blade such as curling normal to the plane of deposition. This distortion can be resisted in part by the greater stiffness provided by the relatively large thickness normal to the plane of deposition provided in the present invention, in example embodiments the blade stiffness can be 50 times greater out-of-plane than in-plane. Previous designs with actuation normal to the plane of deposition can be impractical due to the distortion caused by such strain gradients.

Figure 5:
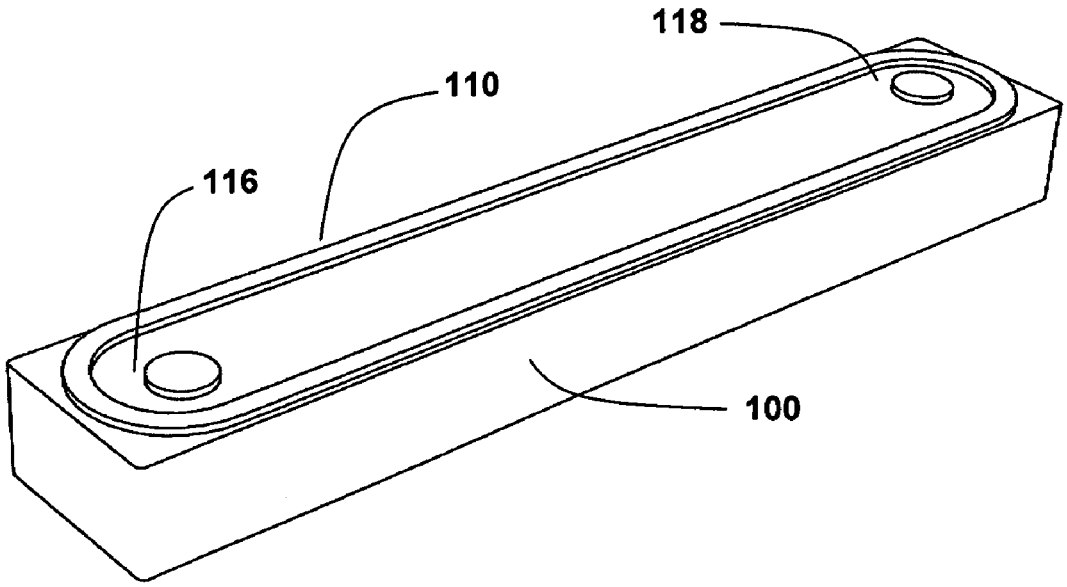
FIG. 5 is a top view of an example integrated reed switch substrate with bonding ring.

FIG. 5 is a view of the substrate 100 with spacing features 116, 118. The spacing features can provide separation of the ferromagnetic blades from the substrate thereby creating a cantilevered blade and allowing for unobstructed motion of the blades. Additionally, a seal ring, 110, can be included in this layer which can provide a bond surface for the cover sidewall, 102, and cap, 104, components.

In operation, a reed switch according to the present invention can be operated through the application of an external magnetic field. This field can, for example, be generated by a permanent magnet or electromagnetic coil. Under the application of a magnetic field, the soft ferromagnetic reeds couple the magnetic field to the reed gap which causes an attracting pressure to be exerted on the overlapping tips of the reed switch blades. In the case of several example embodiments here the reed gap can also comprise a moveable reed cantilever and fixed contact. If the magnetic field is sufficiently high, the reeds will deflect until they touch whereby electrical contact is established through contact metallurgy which coats the blades.

Conventional reed switches are typically fabricated with a hermetic cylindrical glass tube enclosure with electrical leads extending from the ends of the tube. In the conventional configuration, the reed switch is most sensitive along the axis of the cylinder and is thus most amenable to be operated by a co-axially located electromagnet or permanent magnet with its poles oriented along the axis of the cylinder of the reed switch. Example embodiments of an integrated reed switch according to the present invention can have electrical leads extending directly beneath the reed switch in nearly arbitrary locations. The orientation of the most sensitive switching axis can thus be adjusted relative to the location of the electrical connections. Furthermore, by tailoring the aspect ratio and location of the soft ferromagnetic bases as is enabled by this invention, the orientation of highest reed switch sensitivity can be adjusted relative to the package orientation. In addition, a reed switch with more uniform or nearly equal sensitivity across more directions can be provided by the present invention.

Figure 7:
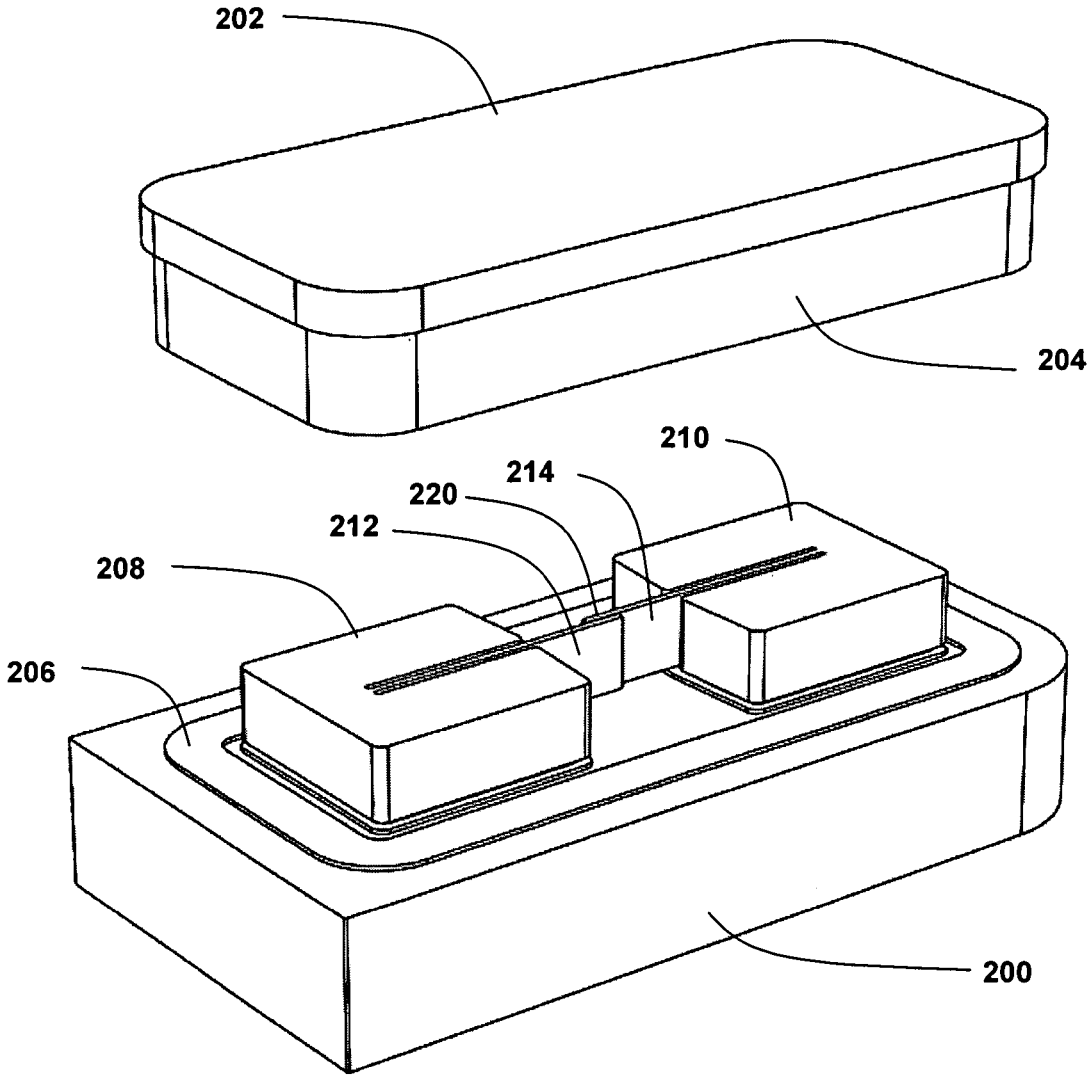
FIG. 7 is a perspective exploded view of an example form A integrated reed switch with extended base anchors.

FIG. 7 is a perspective exploded view of an example form A integrated reed switch with extended base anchors 208, 210 mounted with a substrate 200 having a ring 206 for sealing a cap 202 and walls 204. The example embodiment of FIG. 7 provides a larger reed anchor area that overlaps portions of the reed cantilevers 212, 214. The additional material provides enhanced coupling of external magnetic fields to the reed contact gap 220. These "extended base anchors", for example as illustrated in this and other example embodiments, can provide significant volumes of soft ferromagnetic material that are patterned to be in contact with and adjacent to the cantilever beam(s) to provide enhanced coupling to externally applied magnetic fields. A microfabricated switch without such enhanced coupling can have low sensitivity to applied magnetic field, and the high fields required to activate such a switch can make the switch impractical for many applications. This consideration can be important to switches of any size, but has been observed to be especially important in microfabricated switches since scaling can also affect sensitivity.

Figure 8:
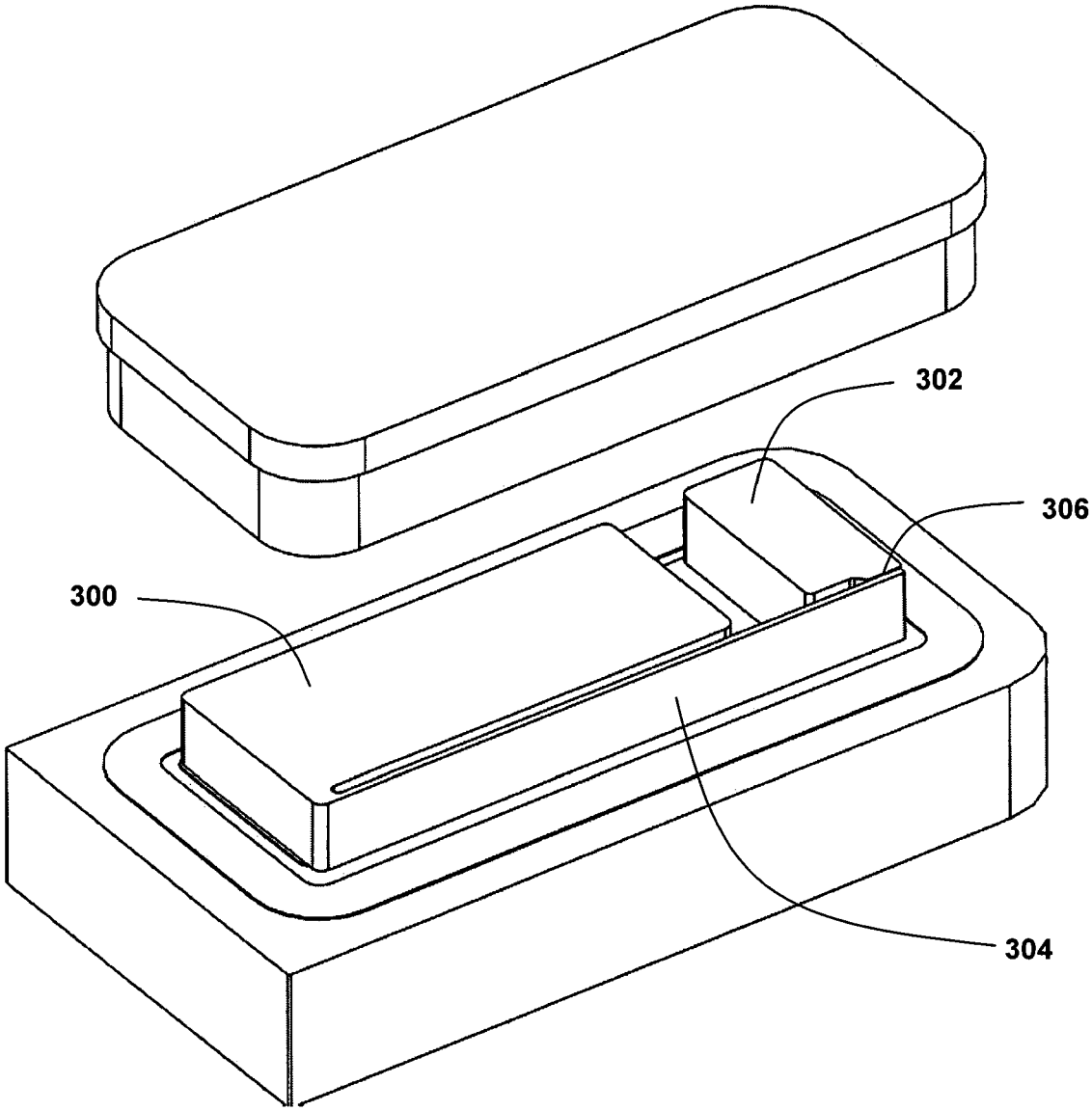
FIG. 8 is a perspective exploded view of an example form A integrated reed switch with a single cantilever and enlarged asymmetric base anchors.
Figure 9:
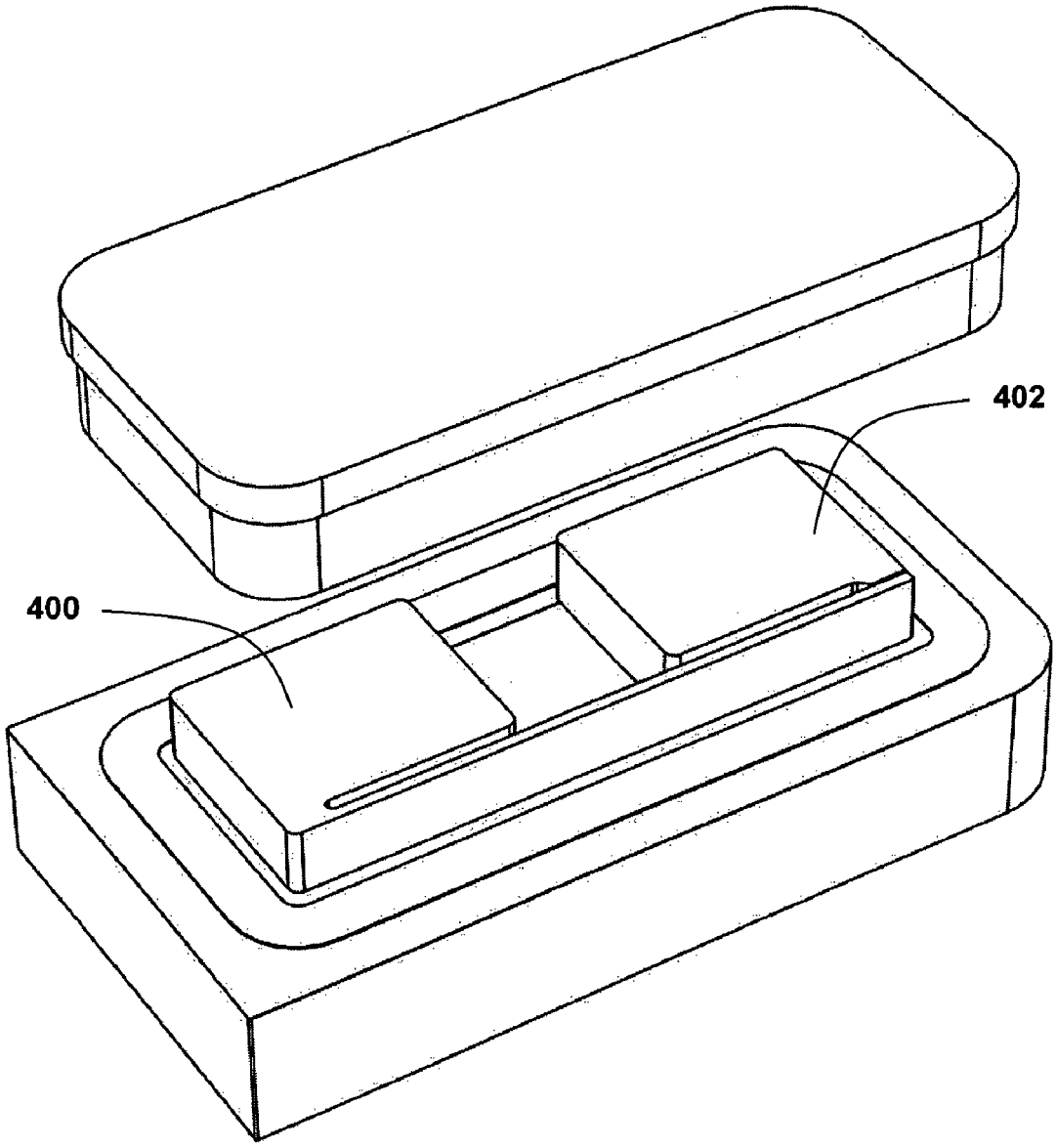
FIG. 9 is a perspective exploded view of an example form A integrated reed switch with a single cantilever and enlarged symmetric base anchors.

FIG. 8 is a perspective exploded view of an example form A integrated reed switch with a single cantilever 300 and enlarged asymmetric base anchors 300, 302. The example embodiment FIG. 8 comprises one cantilever 304 and an opposing stationary contact 302. The example embodiment provides a gap 306 defined by a fixed contact 302 and a moveable cantilever beam 304. In the example embodiment the cantilever base 300 or anchoring region is shown much larger than the corresponding fixed contact base area 302. Alternatively, both base regions can be equal in area as shown in the example embodiment of FIG. 9 where anchor regions 400 and 402 have approximately equal dimensions. Such a configuration provides different magnetic coupling to externally applied magnetic fields than the example embodiment of FIG. 8. Accordingly, by providing different base and blade geometry, the present invention can provide different reed switch sensitivity. A variation in reed switch sensitivity with applied magnetic field direction can also be tailored in this way.

Figure 10:
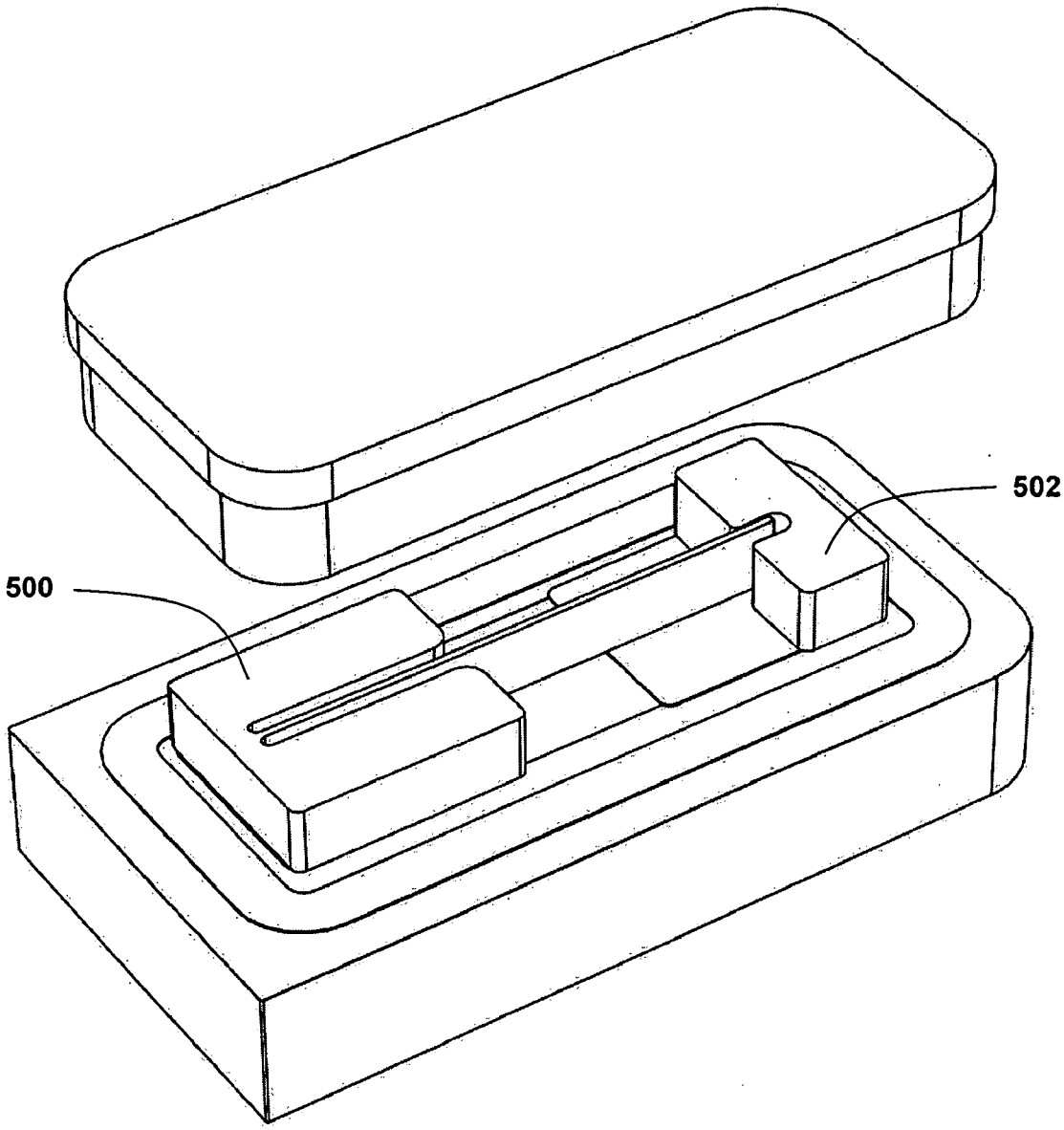
FIG. 10 is a perspective exploded view of an example form A integrated reed switch with a single cantilever and partially enclosed contact.

FIG. 10 is a perspective exploded view of an example form A integrated reed switch with a single cantilever and partially enclosed contact. The example embodiment of FIG. 10 comprises an extended anchor 500 like that described in connection with the example embodiment of FIG. 7 is depicted in FIG. 10. A stationary contact 502 is provided such that the contact area is partially surrounded by soft ferromagnetic material.

Figure 11:
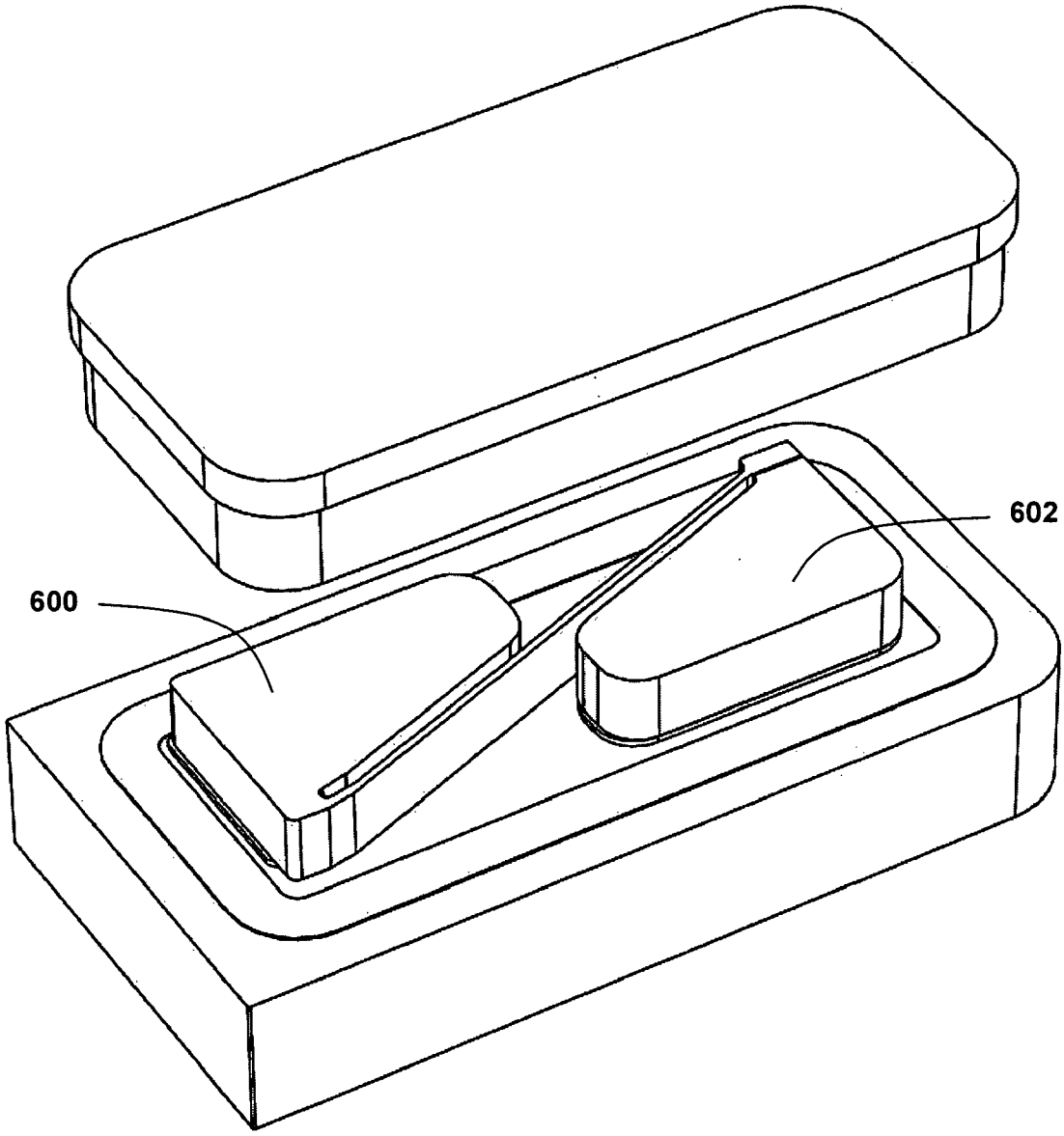
FIG. 11 is a perspective exploded view of an example form A integrated reed switch with a single cantilever oriented diagonally.

FIG. 11 is a perspective exploded view of an example form A integrated reed switch with a single cantilever oriented diagonally. The example embodiment of FIG. 11 provides an anchor 600 and a fixed contact 602, and a cantilever at an angle to the package.

Figure 12:
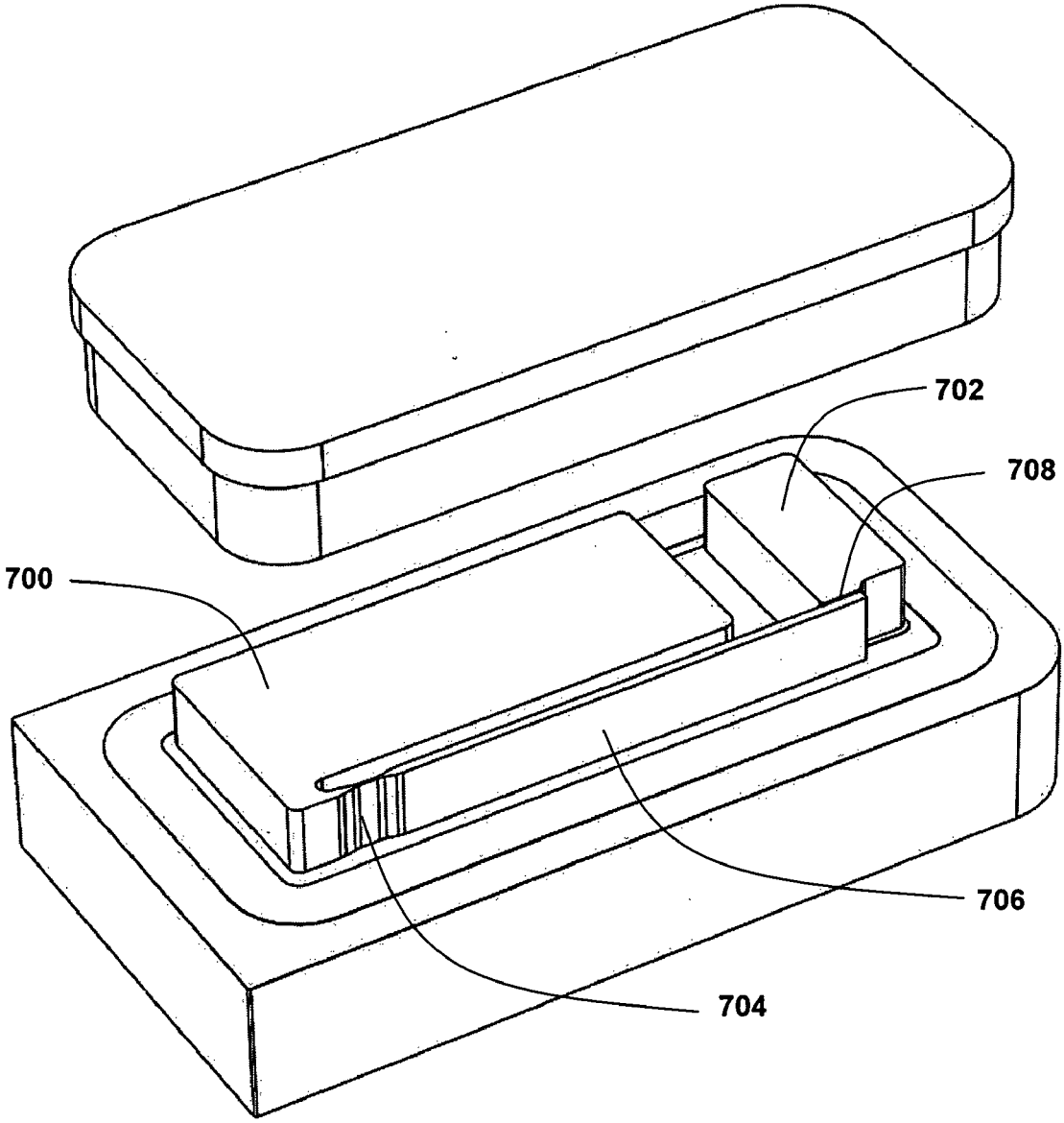
FIG. 12 is a perspective exploded view of an example form A integrated reed switch with a single cantilever with locally narrowed cross section.

FIG. 12 is a perspective exploded view of an example form A integrated reed switch with a single cantilever with locally narrowed cross section. The example embodiment of FIG. 12 provides an anchor 700 and a fixed contact 702. A cantilever 706 has a portion with a reduced cross-section 704. The narrowed cross-section can effectively provide a local flexural hinge about which the cantilever 706 can flex to close the gap 708 and make contact with the fixed contact formed in base 702.

Example Method of Making

Figure 13:
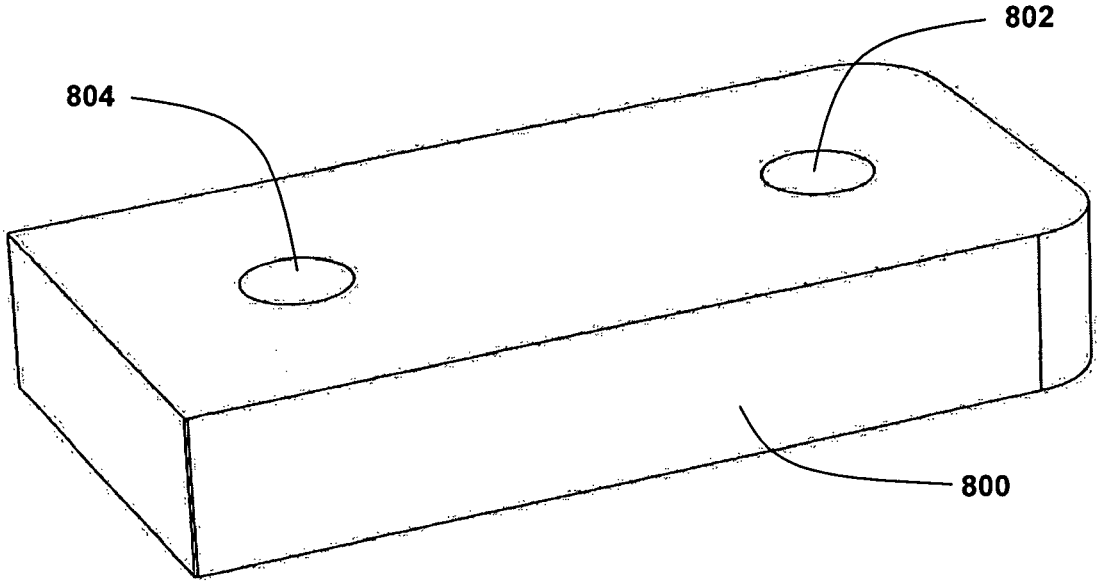
FIG. 13 is a top view of a via substrate used for construction of an example integrated reed switch.

A description of fabrication of an integrated reed switch according to the present invention can begin with preparation of a suitable substrate. A variety of insulating substrates such as alumina, glass, glass-ceramic composite and oxidized silicon can be used. Electrical connection to the reed switch can be provided by vias, formed in holes, which can range in size with diameters of 0.002" to 0.040" for some applications. Such holes can be machined using laser or water jet drilling. The holes can be provided with electrically conductive material by a number of approaches. The selection of an approach can affect a level of hermeticity acceptable to reed switch longevity for the intended application. As examples, the holes can be provided with electrically conductive material by using thin film physical vapor deposition combined with electroplating or by using pressed, sintered, and fired metal powders or conductive plug paste in a ceramic slurry type of process. Suitable electrically conductive materials include gold, silver and copper, as examples. After hole formation and provision of electrically conductive material, a substrate such as that shown in FIG. 13 provides an electrically insulating substrate or wafer 800 with electrically conducting plugs or vias 802, 804. The use of through-substrate vias can be important to compatibility with surface mount electronics packaging and assembly. For example, a reed switch according to the present invention with through-substrate vias for external electrical connections can require minimal "footprint" (space on a circuit board) and can be well-suited to surface mount and ball grid printed circuit technology.

Figure 22:
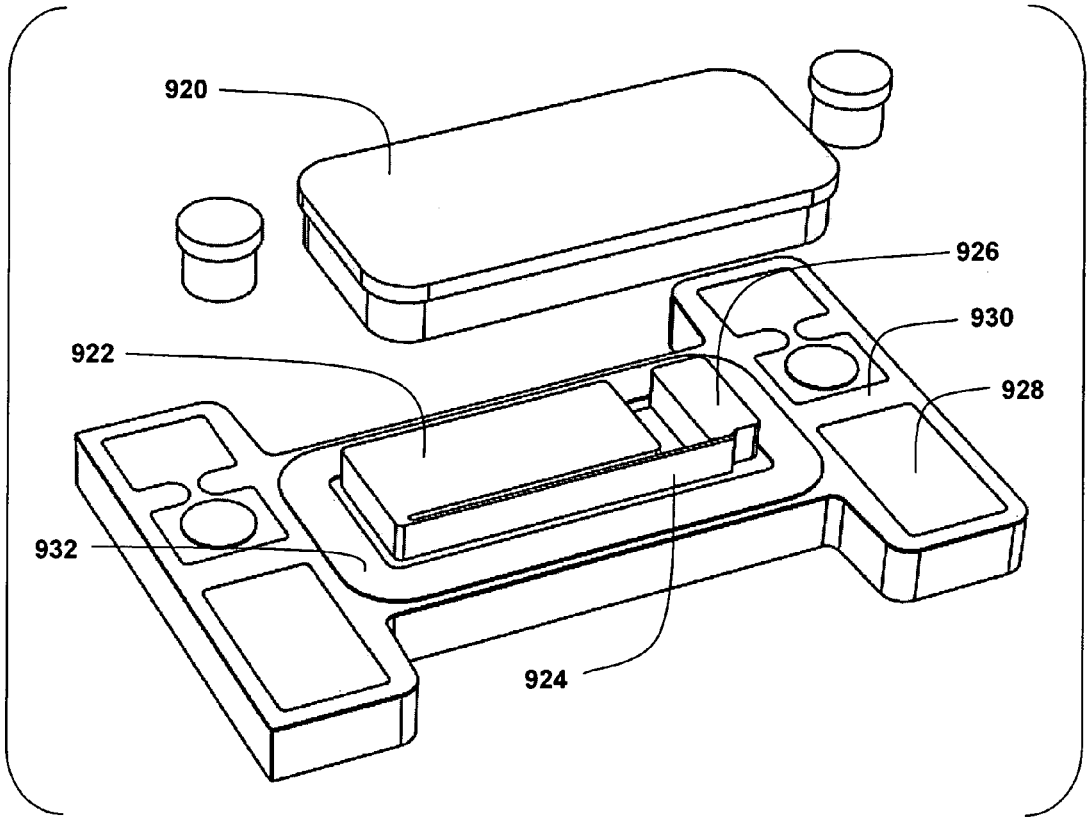
FIG. 22 is an exploded view of a microfabricated high aspect-ratio reed switch with front-side substrate electrical contacts.
Figure 23:
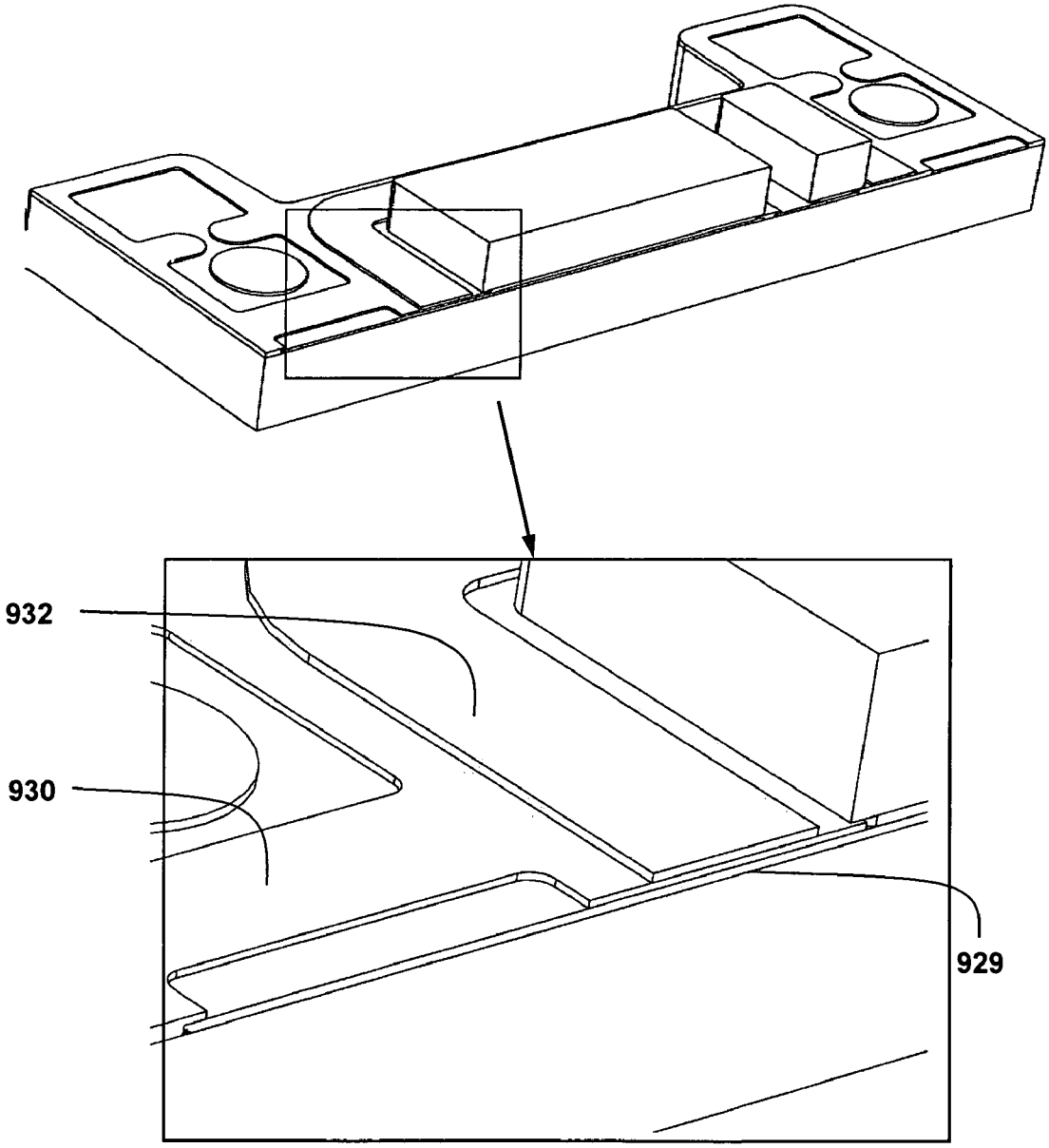
FIG. 23 is a cross section view of an integrated reed switch with topside electrical contact configuration.

Alternatively, insulated vias can be provided on the substrate surface by use of multi-layer metal and inter-layer dielectric processing. An example implementation is shown in FIG. 22. Included in this particular embodiment of an integrated high aspect-ratio microfabricated magnetic reed switch is an electrically insulating substrate, 920, with ferromagnetic components 923, 924 and 926 and cover consisting of a cap 921 and sidewall 922. Frontside electrical connections are implemented with layers which provide metallization and bond pads 928 with electrical connections to the reed switch and dielectric 930 isolation between this metallization layer and the electrically conductive cap seal ring 932. In this way, therefore, electrical connection is made to the interior hermetic cavity of the switch on the frontside of the substrate. The frontside metallization layer can then be used to connect multiple devices together or to connect to other electrical or electromechanical components.

Figure 14:
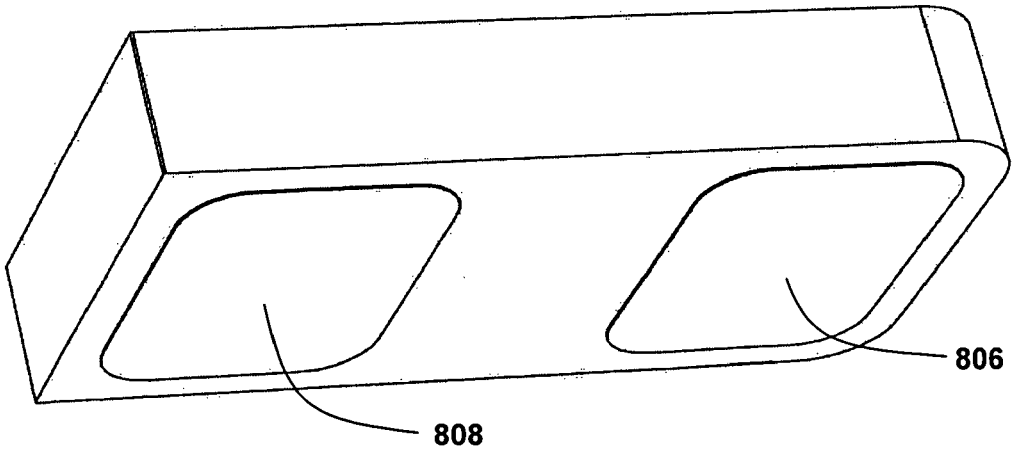
FIG. 14 is a view of bottom electrical pad connections for an example reed switch.

Another step in the fabrication sequence can create electrical pads 806, 808 on the backside of the substrate as shown in FIG. 14. This can be accomplished using standard metal patterning of gold or tin, for example, to provide a means of external electrical connection. These pads, which can be soldered or bonded to in application of the final reed switch, can provide the electrical interface from outside the reed switch package to the conductive material in the vias.

Figure 15:
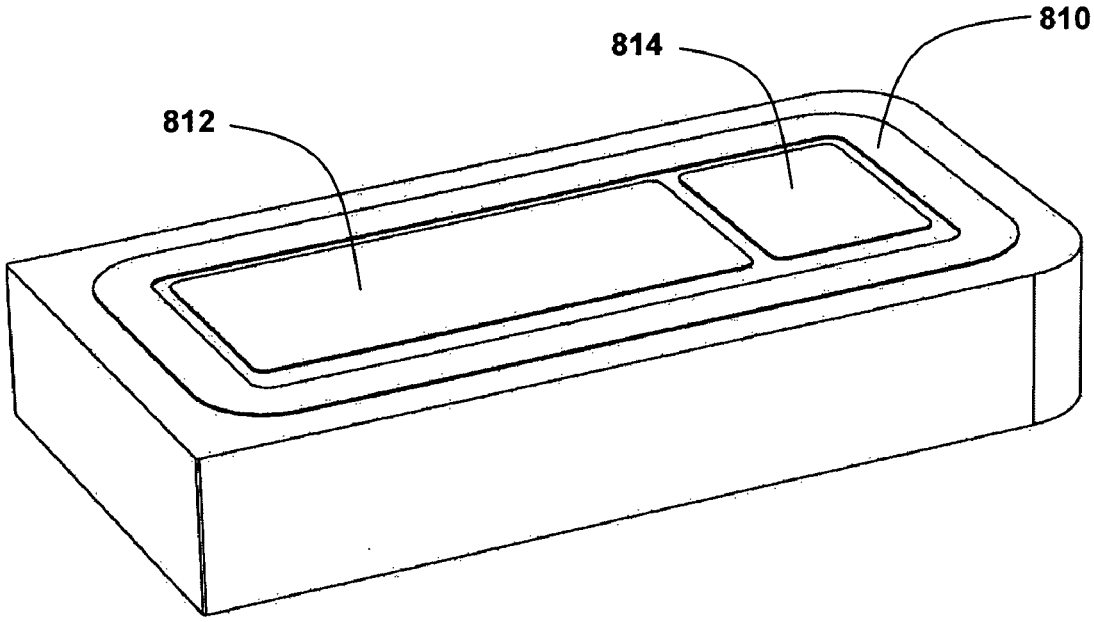
FIG. 15 is a perspective view of an example via substrate with metal electrical patterns and bond ring.

A complementary metal pattern depicted in FIG. 15 can be created on the substrate frontside that provides electrical connection to reed switch bases through geometry such as 812 and 814. The geometry of the frontside connection can be configured to be appropriate for the anchor and contact portions of the particular reed switch design. The frontside metal pattern can also comprise a bond ring 810 to provide a base for a cover seal. This frontside layer can be constructed from a variety of conductive materials including gold whereby a gold diffusion bond can then be used attach the ferromagnetic components and hermetically seal the cover. Both back and frontside metallization patterns can be fabricated from a variety of planar processing metallization techniques including sputtering or evaporation of metal with a lift-off lithographic technique or by through-photoresist electroplating.

Figure 16:
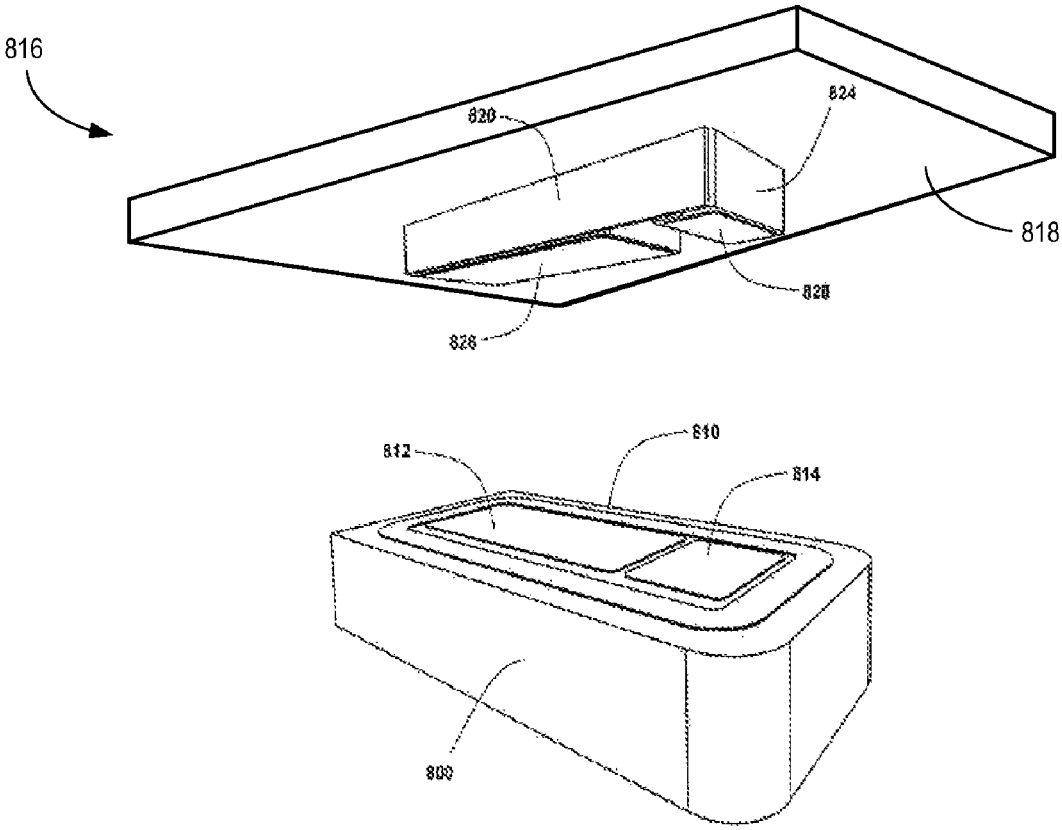
FIG. 16 is a perspective view of an example ferromagnetic material bond step.
Figure 17:
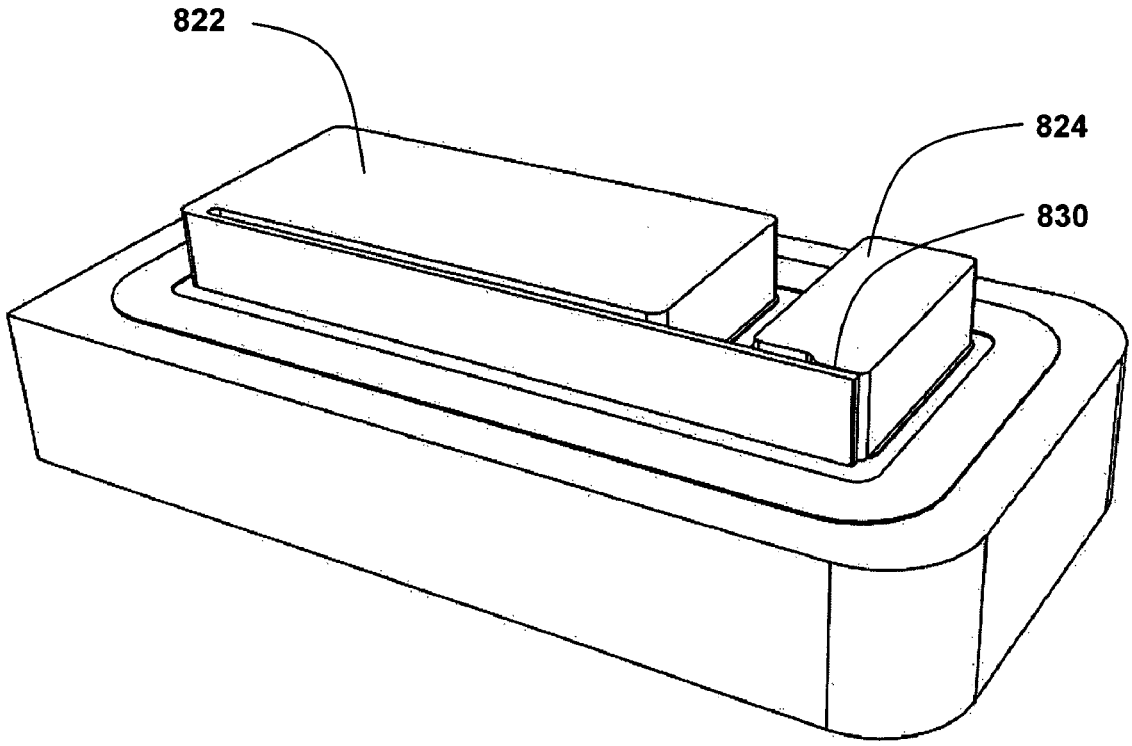
FIG. 17 is a perspective view of an example integrated reed switch during fabrication after bonding of the reed components.

FIG. 16 is a perspective view of an example ferromagnetic material bond step. FIG. 17 is a perspective view of an example integrated reed switch during fabrication after bonding of the reed components. Patterned ferromagnetic components 820, 822 and 824 are bonded to the main substrate 800. Second substrate 816 comprises handle substrate 818 and patterned ferromagnetic components 820, 822, and 824, which are mounted on handle substrate 818. Handle substrate 818 provides a stable platform that is used for the fabrication of the ferromagnetic components and to retain them during bonding. After bonding, handle substrate 818 is removed by, as examples, selective chemical etching of a sacrificial layer residing between the ferromagnetic parts and the second substrate or by bulk dissolution of the second substrate. FIG. 17 depicts the example integrated reed switch after removal of handle substrate 818. The bonding can be accomplished by metal diffusion bonding (solid-state welding), transient liquid phase bonding, brazing, or solder reflow, for example. A spacing pattern 826, 828 can also be provided proud of the ferromagnetic components 822 and 824 to provide a bond layer located within the ferromagnetic region. This spacing layer can provide additional clearance for the ferromagnetic blade, 820, as it moves in response to a magnetic field to make electrical connection with the contact region 824. Additionally, the blade 820 and fixed contact 824 can be provided with a suitable electrical contact layer typically prior to bonding and transfer to the main substrate 800. Suitable contact metals such as Rh and Ru can be electroplated on the ferrromagnetic base layer with the addition of a dielectric field layer to prohibit electroplating of the contact metal between structures which can otherwise prevent release of the ferromagnetic structures during their transfer to the main substrate 800. Additionally, by slightly undercutting the sacrificial layer beneath the ferromagnetic layer structures, contact metal can be deposited by various physical vapor deposition methods such as evaporation or sputtering. The steps described can be used in fabrication of the example shown in FIG. 17, and can also be used, with corresponding modifications of element shapes, with other embodiments including without limitation the example embodiments described elsewhere herein.

Figure 18:
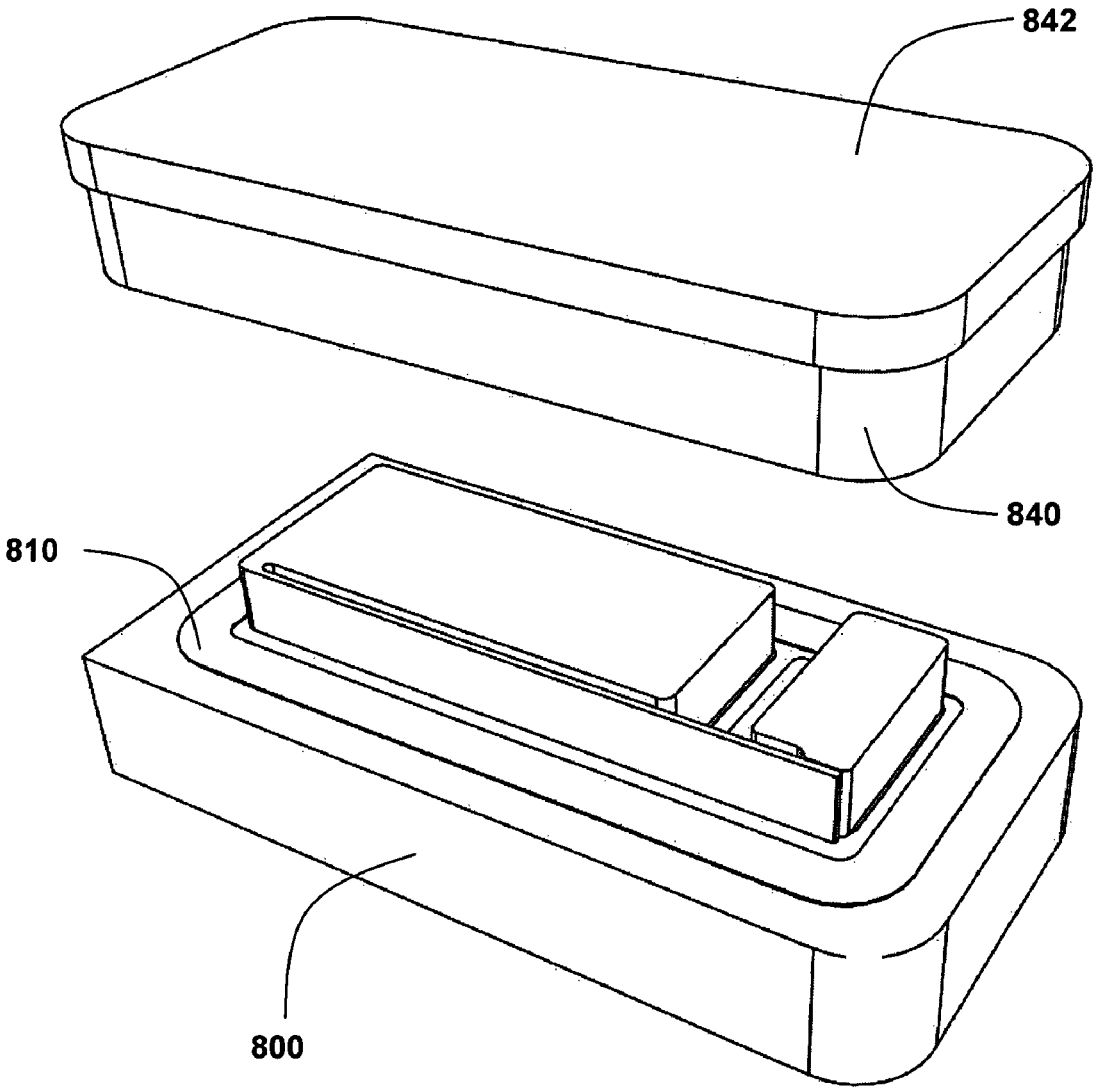
FIG. 18 is a perspective view of an example cap bond step.
Figure 19:
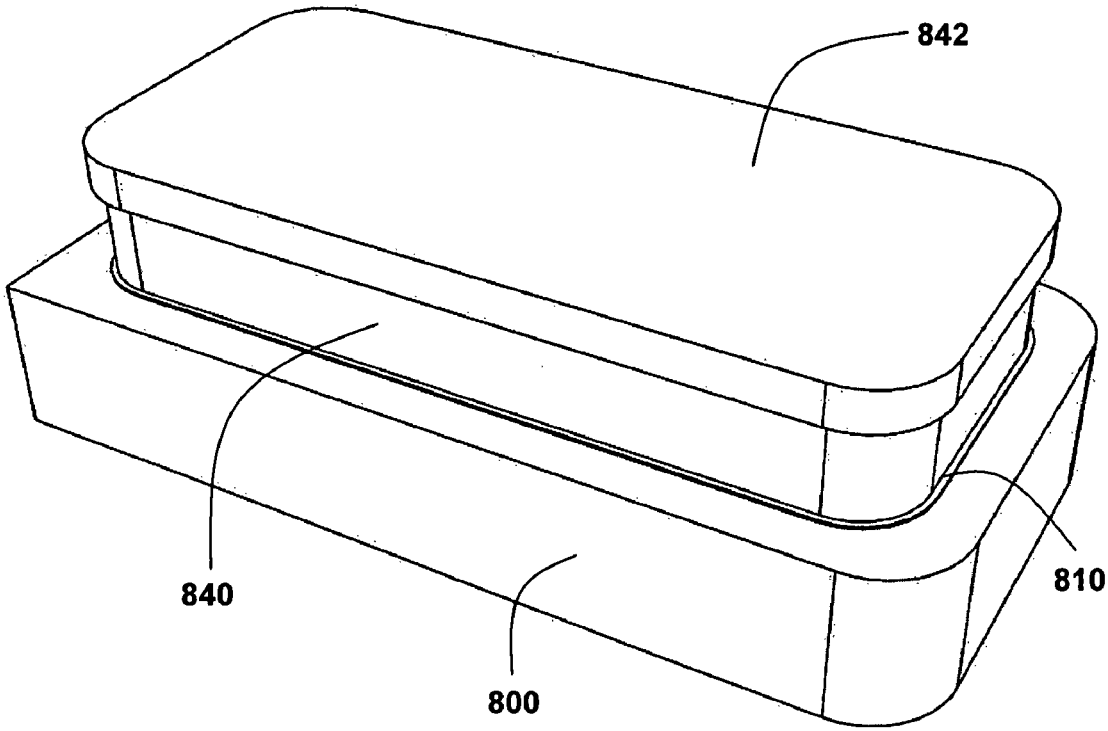
FIG. 19 is a perspective view of an example integrated reed switch after the cap has been bonded.
Figure 20:
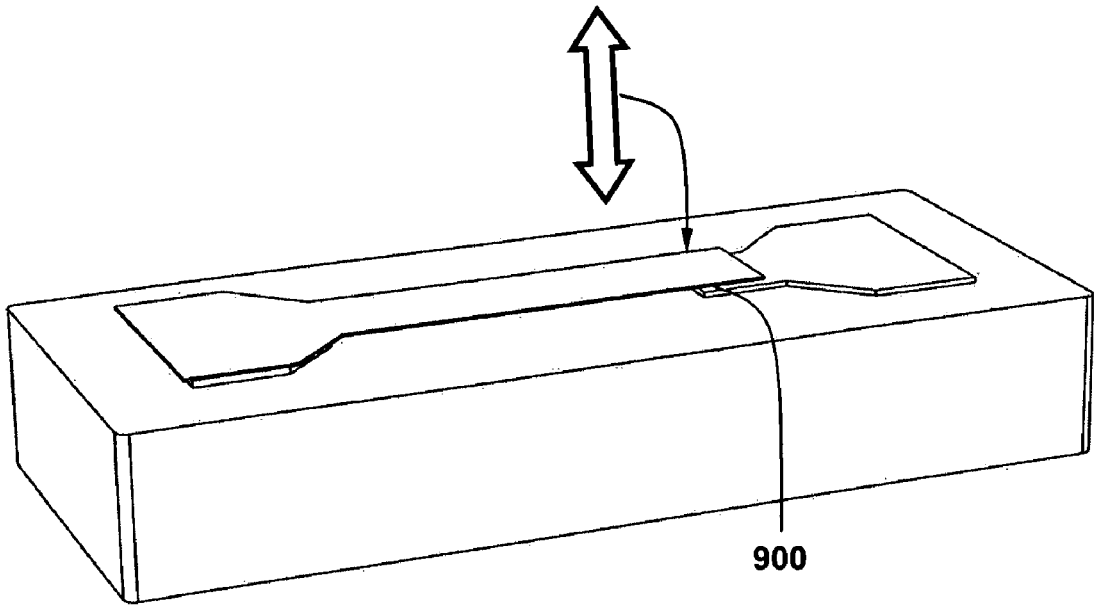
FIG. 20 is a perspective view of a planar thin-film microfabricated switch with contact motion normal to the fabrication substrate.
Figure 21:
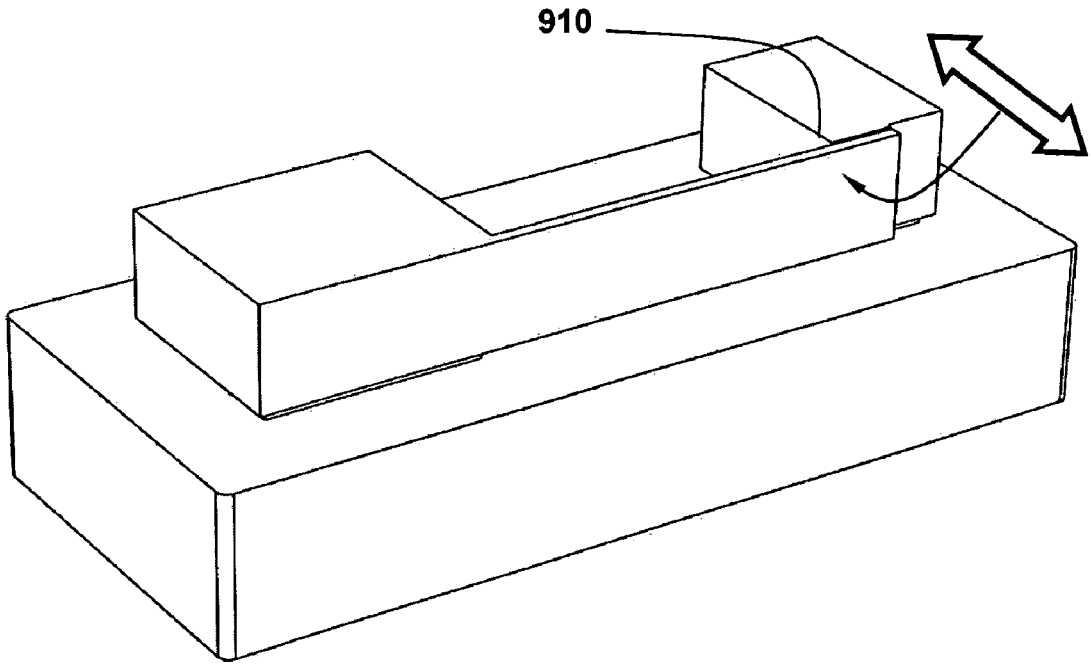
FIG. 21 is a perspective view of a microfabricated switch created with high aspect ratio fabrication with contact motion parallel to the fabrication substrate.

In order to create a hermetically sealed switch, a cap fabricated from a suitable hermetic material which surrounds the device is required. In a manner similar to the bonding of the ferromagnetic layer, a cap comprising cover 842 and sidewall 840 can be bonded to the bond ring 810 by a metal diffusion bond to create a hermetically sealed cavity around the reed switch as shown in FIG. 18. The result after removing the substrate which initially supported the covers is shown in FIG. 19. The cap material can comprise a non magnetic material to allow coupling of external magnetic fields to the soft ferromagnetic reed switch components. Glass can also be used as a cap material and anodically bonded or fused to a corresponding suitable bond ring material which can comprise glass or a semiconductor such as silicon.

Example Embodiment with Sidewall and Cap

Figure 24:
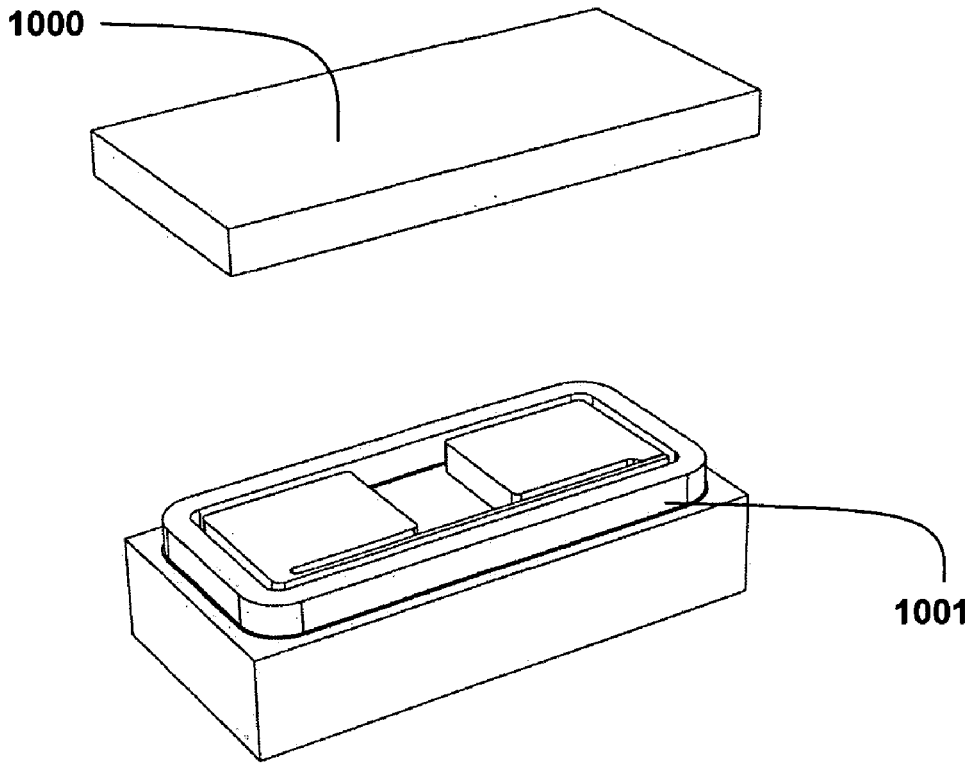
FIG. 24 is a perspective view of an example embodiment of the present invention with a cap and sidewall.
Figure 25:
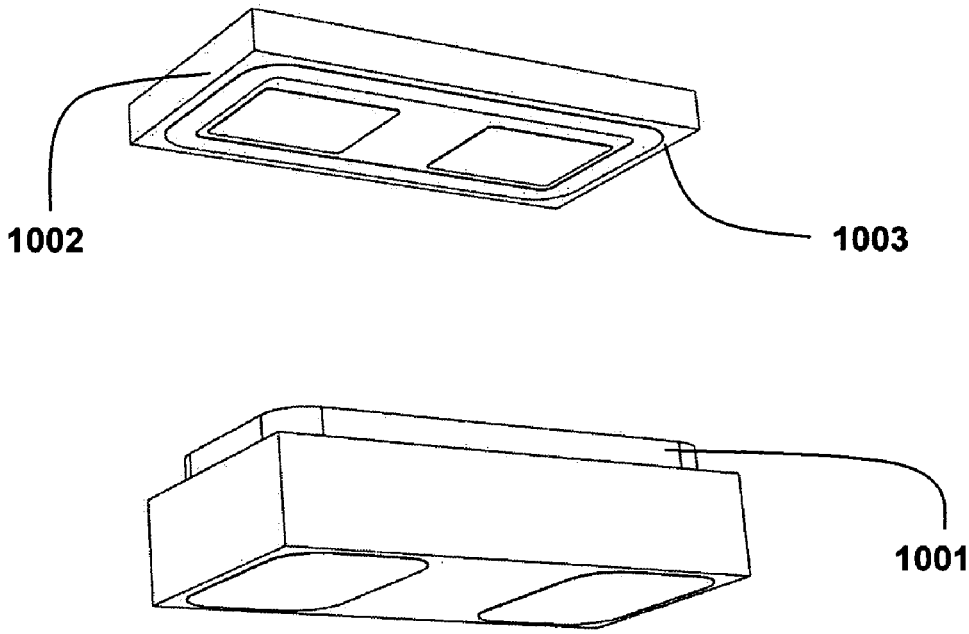
FIG. 25 is a perspective view of an example embodiment of the present invention with a cap and sidewall.

FIG. 24 and 25 are perspective views of an example embodiment of a reed switch with sidewalls 1001 and a cap 1000. Other example embodiments described herein comprise a cap having two layers: a planar layer and a sidewall layer, such that the sidewall is mounted with the reed switch and positioned within the planar layer above the switch elements. In the example embodiments of FIGS. 24 and 25, a sidewall layer 1001 is formed as part of the switch fabrication process. The cap can then comprise a layer 1002, e.g., of a dielectric or metal material, that mounts with the sidewalls 1001 previously created as part of the switch through the use of a relatively thin spacing pattern 1003. This approach provides a wafer level bonded substrate sandwich for which the cap can be created during singulation or wafer dicing (instead of lithographically).

The particular sizes and equipment discussed above are cited merely to illustrate particular embodiments of the invention. It is contemplated that the use of the invention can involve components having different sizes and characteristics. It is intended that the scope of the invention be defined by the claims appended hereto.

I claim:

1. A method of making a reed switch, comprising:

a. Providing a first substrate having first and second electrical contacts;

b. Forming reed switch elements on a second substrate;

c. Bonding the first substrate to the reed switch elements such that certain of the reed switch elements are in electrical communication with the first and second electrical contacts;

d. Removing the second substrate from the reed switch elements;

e. Mounting a cap with the first substrate such that the reed switch elements are within a volume defined by the cap and the first substrate and such that the first and second electrical contacts extend outside the volume.

2. A method as in claim 1, wherein providing the first substrate comprises providing a substantially planar substrate, forming two holes through the substrate, and supplying electrically conductive material extending the length of the holes.

3. A method as in claim 2, further comprising depositing electrically conductive material on a surface of the first substrate in electrical communication with the electrically conductive material in the first hole.

4. The method of claim 1, wherein the reed switch elements are formed such that they comprises a first anchor, a first reed, and a second anchor, and wherein the first substrate defines a first plane and is bonded to the reed switch elements such that;

(i) the first anchor is in electrical communication with the first electrical contact and is substantially immovable with respect to the first substrate;

(ii) the second anchor is in electrical communication with the second electrical contact and is substantially immovable with respect to the first substrate;

(iii) the first reed is mounted with the first anchor such that it is in electrical communication with the first electrical contact and such that the first reed is substantially selectively movable along a direction that is substantially parallel with the first plane; and (iv) the first reed and second anchor collectively enable electrical communication between the first electrical contact and second electrical contact based on application of a suitable magnetic field to the reed switch.

5. The method of claim 1, wherein the reed switch elements are formed such that they comprise a first reed and a second reed, and wherein the first substrate defines a first plane and is bonded to the reed switch elements such that;

(i) the first reed has a first end that is in electrical communication with the first electrical contact, wherein the first reed is substantially selectively flexible in a second plane that is substantially parallel with the first plane;

(ii) the second reed has a second end that is in electrical communication with the second electrical contact, wherein the second reed is substantially selectively flexible in the second plane; and (iii) the first reed and second reed collectively enable electrical communication between the first electrical contact and second electrical contact based on application of a suitable magnetic field to the reed switch.

6. A method of making a reed switch, the method comprising: providing a first substrate having first and second electrical contacts;

providing a second substrate having a handle substrate and a first layer of ferromagnetic material, the first layer comprising a first reed and a first anchor, wherein the first reed has a first end that is physically coupled with the first anchor; attaching the first anchor and the first substrate to one another, wherein the first reed and the first electrical contact are electrically coupled via the first anchor; and removing the handle substrate after the first anchor and the first substrate are attached to one another.

7. The method of claim 6, wherein the first layer is provided such that it defines a first plane, and wherein the first reed is provided such that it is dimensioned and arranged to be selectively flexible in the first plane, and further wherein the first anchor is provided such that it comprises a first sidewall that is orthogonal to the first plane and proximate to a first portion of the first reed.

8. The method of claim 6, further comprising:

providing a second anchor; and attaching the second anchor and the first substrate to one another such that the second anchor and the second electrical contact are electrically coupled.

9. The method of claim 8, further comprising providing a second reed having a first end that is physically coupled with the second anchor, wherein the second reed is electrically coupled with the second electrical contact via the second anchor.

10. The method of claim 9, wherein the first reed, first anchor, second reed, and second anchor are provided by operations that include providing the second substrate such that it includes a handle substrate and a first layer of ferromagnetic material, the first layer comprising the first reed, first anchor, second reed, and second anchor;

wherein the method further comprises removing the handle substrate after the attachment of the first substrate and each of the first anchor and second anchor.

11. The method of claim 10, wherein the first layer is provided such that it defines a first plane, and wherein the first reed is provided such that it is dimensioned and arranged to be selectively flexible in the first plane, and further wherein the second anchor is provided such that it comprises a first sidewall that is orthogonal to the first plane and proximate to a first portion of the first reed.

12. The method of claim 11, wherein the first anchor is provided such that it comprises a second sidewall that is orthogonal to the first plane and proximate to a second portion of the first reed.

13. The method of claim 6, further comprising providing a first spacer comprising a material that is substantially electrically conductive, wherein the first spacer is provided such that it interposes the first electrical contact and the first anchor when the first anchor and the first substrate are attached to one another.

14. A method of making a reed switch, the method comprising:

providing a first substrate having first and second electrical contacts;

providing second substrate including a handle substrate and a first layer that comprises a ferromagnetic material, wherein the first layer includes a first reed, a first anchor, and a second anchor, and wherein the first reed has a first end that is physically coupled with the first anchor;

attaching the first substrate and the second substrate together such that the first anchor is in electrical communication with the first electrical contact and the second anchor is in electrical communication with the second electrical contact; and removing the handle substrate.

15. The method of claim 14, wherein the operation of providing the second substrate further comprises:

forming the first layer on the handle substrate, wherein the first layer defines a first plane; and patterning the first layer to define the first reed, the first anchor, and the second anchor, wherein the first reed is patterned such that the first reed is dimensioned and arranged to be selectively flexible in the first plane, and wherein at least one of the first anchor and the second anchor is patterned such that it comprises a sidewall that is orthogonal to the first plane and proximate to a portion of the first reed.

16. The method of claim 14, wherein the second substrate is provided such that the first layer further comprises a second reed that has a first end that is physically coupled with the second anchor and in electrical communication with the second anchor.

17. The method of claim 16, wherein operation of providing the second substrate further comprises:

forming the first layer on the handle substrate, wherein the first layer defines a first plane; and patterning the first layer to define the first reed, the first anchor, the second reed, and the second anchor, wherein each of the first reed and the second reed is patterned such that it is dimensioned and arranged to be selectively flexible in the first plane, and wherein the first anchor is patterned such that it comprises a sidewall that is orthogonal to the first plane and proximate to a portion of the first reed, and further wherein the second anchor is patterned such that it comprises a sidewall that is orthogonal to the first plane and proximate to a portion of the second reed.

18. The method of claim 16, wherein the first substrate is provided such that the first electrical contact and the second electrical contact are disposed on a first major surface of the first substrate, and such that the first substrate further comprises:

a first bond pad disposed on a second major surface of the first substrate, wherein the second major surface and second major surface are opposite surfaces of the first substrate, and wherein the first bond pad and the first electrical contact are in electrical communication; and a second bond pad disposed on the second major surface, wherein the second bond pad and the second electrical contact are in electrical communication;

wherein the operation of attaching the first substrate and the second substrate together attaches the first anchor to the first bond pad and the second anchor to the second bond pad.

* * * * *